US010663198B2

(12) United States Patent
Hu et al.

(10) Patent No.: US 10,663,198 B2
(45) Date of Patent: May 26, 2020

(54) HEAT PUMP SYSTEM AND AIR-CONDITIONER

(71) Applicants: GUANGXI UNIVERSITY, Nanning (CN); GUANGXI JUNFUHUANG GROUND SOURCE HEAT PUMP CO., LTD, Nanning (CN)

(72) Inventors: Yingning Hu, Guangxi (CN); Biao Li, Guangxi (CN); Jun Lin, Guangxi (CN); Chengyong Wang, Guangxi (CN)

(73) Assignee: GUANGXI UNIVERSITY, Nanning (CN)

( * ) Notice: Subject to any disclaimer, the term of this patent is extended or adjusted under 35 U.S.C. 154(b) by 2 days.

(21) Appl. No.: 15/663,816

(22) Filed: Jul. 30, 2017

(65) Prior Publication Data

US 2018/0003418 A1 Jan. 4, 2018

Related U.S. Application Data

(63) Continuation-in-part of application No. 14/066,703, filed on Oct. 30, 2013, now abandoned.

(30) Foreign Application Priority Data

Aug. 16, 2013 (CN) ..... 2013 1 0358748

(51) Int. Cl.
*F25B 30/02* (2006.01)
*F24F 13/22* (2006.01)
(Continued)

(52) U.S. Cl.
CPC ..... *F25B 30/02* (2013.01); *F24F 3/001* (2013.01); *F24F 5/001* (2013.01); *F24F 5/0089* (2013.01);
(Continued)

(58) Field of Classification Search
CPC ..... F25B 30/02; F25B 30/00; F24F 5/0089; F24F 5/001; F24F 3/001; F24F 13/222; F24F 2203/02; F24F 2003/003
See application file for complete search history.

(56) References Cited

U.S. PATENT DOCUMENTS 3,220,212 A 11/1965 Fordsmand
3,292,388 A 12/1966 Schuchardt
(Continued)

FOREIGN PATENT DOCUMENTS

EP 2667108 A1 11/2013
WO 2012099141 A1 7/2012
(Continued)

OTHER PUBLICATIONS

European Search Report dated Feb. 16, 2018 in the corresponding European application(application No. 13189788.6).

*Primary Examiner* — Emmanuel E Duke
(74) *Attorney, Agent, or Firm* — Kilpatrick Townsend & Stockton LLP

(57) ABSTRACT

A heat pump system includes a main heat pump system, a heat retaining layer and a reflecting layer coated on an partial inner surface of a building, a directly expanded strong cool-heat radiation plate having a distance from the reflecting layer, a heat radiating layer located at a side of the directly expanded strong cool-heat radiation plate and having a distance from the directly expanded strong cool-heat radiation plate, a buffer plate disposed between the heat radiating layer and the directly expanded strong cool-heat radiation plate, an anti-condensation trough disposed below the directly expanded strong cool-heat radiation plate. A sealed cavity is enclosed by the heat radiating layer and a wall surface, and the wall surface is formed by a combination of the partial inner surface of the building, the heat
(Continued)

retaining layer and the reflecting layer, and, the sealed cavity is filled with air.

13 Claims, 9 Drawing Sheets

(51) Int. Cl.
*F25B 30/00* (2006.01)
*F24F 3/00* (2006.01)
*F24F 5/00* (2006.01)

(52) U.S. Cl.
CPC ..... *F24F 13/222* (2013.01); *F25B 30/00* (2013.01); *F24F 2003/003* (2013.01); *F24F 2203/02* (2013.01)

(56) References Cited

U.S. PATENT DOCUMENTS 4,286,420 A * 9/1981 Pharmakidis ..... E04B 1/74 52/404.1
5,267,450 A 12/1993 Takegawa et al.
2014/0283541 A1* 9/2014 Feng ..... F24F 5/0085 62/324.6

FOREIGN PATENT DOCUMENTS

WO 2013026206 A1 2/2013
WO 2013176211 A1 11/2013

* cited by examiner

HEAT PUMP SYSTEM AND AIR-CONDITIONER

CROSS-REFERENCE TO RELATED APPLICATION

This application is a Continuation-in-part of application Ser. No. 14/066,703, entitled "HEAT PUMP SYSTEM AND AIR-CONDITIONER", filed on Oct. 30, 2013, which claims the priority to the Chinese Patent Application No. 201310358748.4 filed with the Chinese Patent Office on Aug. 16, 2013, entitled "HEAT PUMP SYSTEM AND AIR-CONDITIONER", the entire disclosures of which are incorporated herein by this reference.

FIELD OF THE INVENTION

The present application relates to an air-conditioner, and in particular, to a heat pump system and an air-conditioner.

BACKGROUND OF THE INVENTION

The air-conditioner generally refers herein to a room air conditioner, and specifically is a set for providing conditioned air into a room (or an enclosed space or area). Most of conventional air-conditioners perform cooling or heating in the room in convective heat-transfer manner. Specifically, a fan coil may serve as the terminal unit of an air-conditioner. A fan is provided in the fan coil in advance. Air in the region of the fan coil is circulated continuously under the action of the fan. The air is cooled or heated after flowing through a refrigerant coil or a hot-water (or chilled-water) coil, thereby cooling or heating the room. Because cooling or heating is achieved in the convective heat-transfer manner, the indoor temperature is not uniform. Either cooling or heating, the indoor temperature difference is generally greater than 10 degrees centigrade, even more than 20 degrees centigrade. Part of the cool or hot airflow is too large, which results in uncomfortableness of a human body, local cold, or even illness.

In order to solve the above problem, a radiation coil is adopted at the terminal of air-conditioner. The radiation coil is provided therein with chilled water (or hot water), and is arranged on the surface structure of the building (the ceiling surface or the ground surface). The chilled water (or hot water) in the radiation coil cools or heats a particular area in radiating manner. Such a structure of air-conditioner achieves the uniform cooling or heating to a certain extent, however, the water circulation loop of the radiation coil is required to exchange heat with a heat exchanger in a refrigerant loop of an air-conditioner firstly, and then exchange heat with the indoor air, thereby adding an intermediate heat exchange procedure and increasing the energy consumption of a power apparatus for delivering water circulation, for example, a circulating pump. Thus, the efficiency of heat exchange is low, and the installation of the system is complex.

In conclusion, it is desirable for the person skilled in the art to improve the efficiency of heat exchange.

SUMMARY OF THE INVENTION

In view of the above fact, there are provided according to the present application a heat pump system and an air-conditioner which may increase the efficiency of heat exchange. In order to achieve the above objects, the following technical solutions are set forth in the present application.

A heat pump system includes: a main heat pump system; a heat retaining layer coated on an partial inner surface of a building; a reflecting layer coated on the heat retaining layer; a directly expanded strong cool-heat radiation plate having a distance from the reflecting layer, wherein an interior of the directly expanded strong cool-heat radiation plate is communicated with the main heat pump system such that refrigerant is circulated in the directly expanded strong cool-heat radiation plate and the main heat pump system; a heat radiating layer located at a side, towards an interior of a room, of the directly expanded strong cool-heat radiation plate and having a distance from the directly expanded strong cool-heat radiation plate; a supporting rod for supporting the heat radiating layer; a first bracket for supporting the directly expanded strong cool-heat radiation plate; a buffer plate disposed between the heat radiating layer and the directly expanded strong cool-heat radiation plate, wherein the buffer plate is configured to weaken the transferring cool or heat quantity from the directly expanded strong cool-heat radiation plate to the room; a second bracket for supporting the buffer plate; an anti-condensation trough disposed below the directly expanded strong cool-heat radiation plate, wherein the anti-condensation trough includes a condensation discharging pipe extending out of the room; wherein a sealed cavity is enclosed by the heat radiating layer and a wall surface, and the wall surface is formed by a combination of the partial inner surface of the building, the heat retaining layer and the reflecting layer, and, the sealed cavity is filled with air.

Preferably, the directly expanded strong cool-heat radiation plate is a single piece.

Preferably, the directly expanded strong cool-heat radiation plate includes multiple pieces, and the multiple pieces of the directly expanded strong cool-heat radiation plate are interconnected in series or in parallel.

Preferably, when the directly expanded strong cool-heat radiation plate is disposed on a top inner surface of the building, the heat radiating layer is a ceiling; when the directly expanded strong cool-heat radiation plate is disposed on a ground inner surface of the building, the heat radiating layer is a floor; when the directly expanded strong cool-heat radiation plate is disposed on a vertical inner surface of the building, the heat radiating layer is a false wall layer.

Preferably, when the directly expanded strong cool-heat radiation plate is disposed on the top inner surface of the building, the wall surface is formed by a combination of the top inner surface and partial vertical inner surface above the heat radiating layer as well as the heat retaining layer and the reflecting layer; when the directly expanded strong cool-heat radiation plate is disposed on the ground inner surface of the building, the wall surface is formed by a combination of the ground inner surface and partial vertical inner surface below the heat radiating layer as well as the heat retaining layer and the reflecting layer; when the directly expanded strong cool-heat radiation plate is disposed on the vertical inner surface of the building, the wall surface is formed by a combination of partial vertical inner surface, partial top inner surface, and partial ground inner surface as well as the heat retaining layer and the reflecting layer.

Preferably, the directly expanded strong cool-heat radiation plate is provided with multiple louvers for enhancing nature convection.

Preferably, the directly expanded strong cool-heat radiation plate is a plate having multiple gaps and formed by multiple copper pipes and multiple fins.

Preferably, the anti-condensation trough is arranged in an inclined way such that condensation is discharged from a discharging port.

An air-conditioner includes a chassis, and the heat pump system according to any one of the above items. The main heat pump system of the heat pump system is provided in the chassis.

Preferably, the air-conditioner further includes a replacement air heat pump system provided in the chassis, wherein a replacement air outlet of the replacement air heat pump system is adapted to be connected to a replacement air inlet of a room.

Preferably, an air heat exchanger is provided between the main heat pump system and the replacement air heat pump system, and wherein a first replacement air outlet of the air heat exchanger is connected to a replacement air inlet of the replacement air heat pump system, a first return air outlet of the air heat exchanger is connected to a heat source side air inlet of the replacement air heat pump system, a second replacement air outlet of the air heat exchanger is connected to a replacement air inlet of the main heat pump system, a second return air outlet of the air heat exchanger is connected to a heat source side air inlet of the main heat pump system, a return air inlet of the air heat exchanger is connected to a return air outlet of the room.

Preferably, a multistage air filter is provided at a replacement air inlet of the air heat exchanger.

Preferably, the return air inlet of the air heat exchanger is also connected to a return air pipe arranged in the room.

A secondary heat exchange of the refrigerant loop and the water circulation loop is needless, thereby reducing loss in intermediate heat exchange, improving the heat exchange efficiency and heat utilization, and omitting the circulating pump for water circulation so as to lower energy consumption and simplify the installation. In the event that the heat pump system has the above technical effects, the air-conditioner with the heat pump system also has the corresponding technical effects.

BRIEF DESCRIPTION OF THE DRAWINGS

To illustrate embodiments of the present application or the technical solution in the prior art more clearly, drawings used in description of the embodiments or the prior art will be described briefly below. Obviously, the drawings described below are only directed to some of the embodiments of the application, and the person skilled in the art may achieve other drawings according to such drawings without creative efforts.

Figure 1:
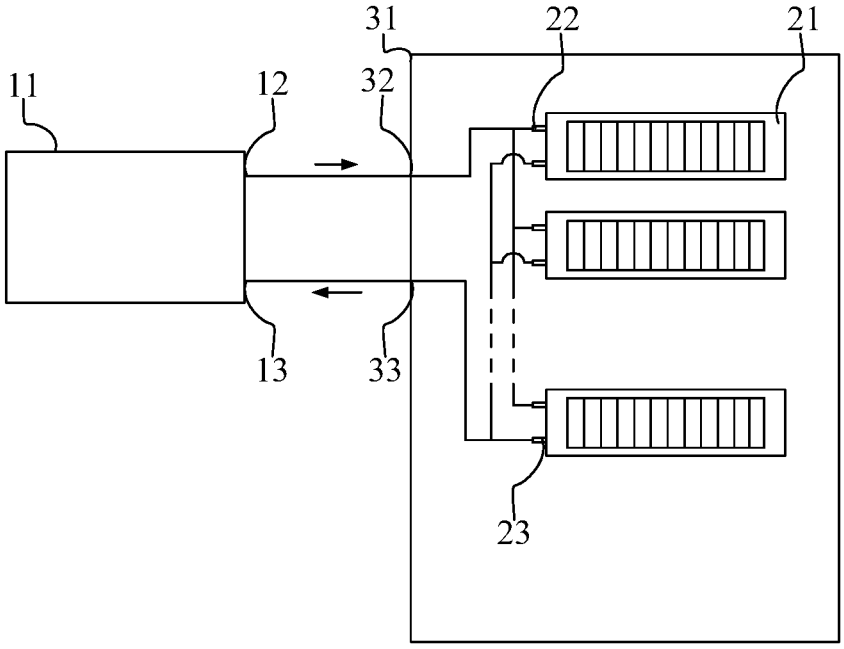
FIG. 1 is a schematic view of a heat pump system according to an embodiment of the present application.

Reference numerals in FIGS. 1 to 11:

11. main heat pump system,
12. working medium outlet of main heat pump system,
13. working medium inlet of main heat pump system,
14. heat source side air inlet of main heat pump system,
15. replacement air inlet of main heat pump system,
16. eduction air outlet of main heat pump system,
17. replacement air outlet of main heat pump system,
21. directly expanded strong cool-heat radiation plate,
22. working medium inlet of directly expanded strong cool-heat radiation plate,
23. working medium outlet of directly expanded strong cool-heat radiation plate,
31. room,
32. first installation port,
33. second installation port,
34. return air outlet,
35. replacement air inlet of room,
36. return air pipe,
40. condensation discharging pipe,
41. inner surface of building,
42. heat radiating layer,
43. first bracket,
44. second bracket,
45. packed layer (air),
46. buffer plate,
47. heat retaining layer,
48. supporting rod,
49. anti-condensation trough,
50. reflecting layer,
51. air heat exchanger,
52. first return air outlet of air heat exchanger,
53. first replacement air outlet of air heat exchanger,
54. second return air outlet of air heat exchanger,
55. second replacement air outlet of air heat exchanger,
56. return air inlet,
57. replacement air inlet of air heat exchanger,
61. replacement air heat pump system,
62. eduction air outlet of replacement air heat pump system,
63. replacement air outlet of replacement air heat pump system,
64. replacement air inlet of replacement air heat pump system,
65. heat source side air inlet of replacement air heat pump system,
7. multi-stage air filter,

DETAILED DESCRIPTION

Hereinafter, the embodiments will be described in conjunction with the drawings. Furthermore, the embodiments illustrated below have no any limitation to inventive contents recited in claims, and are not necessary in its entirety for solutions of inventions defined in the claims.

Referring to FIG. 1, it is a schematic view of a heat pump system according to an embodiment of the present application.

The heat pump system includes a main heat pump system 11, and a directly expanded strong cool-heat radiation plate 21 provided on the inner surface of the building and serving as the terminal of the main heat pump system 11. The interior of the directly expanded strong cool-heat radiation plate 21 enables the circulation of refrigerant in the main heat pump system 11.

Herein, refrigerant in the directly expanded strong cool-heat radiation plate may be directly evaporated, that is, the refrigerant in the directly expanded strong cool-heat radiation plate may be transited from a liquid to a gas, generating vaporization heat, thus, heating or cooling quantity may be higher than simply heat conduction. A strong cool-heat radiation plate refers to a cool-heat radiation plate accommodating a working medium having a temperature lower than a temperature of the working medium in a normal cooling radiating way and accommodating a working medium having a temperature higher than a temperature in a normal heating radiating way. Specifically, a cool-heat radiation plate may accommodate a working medium having a temperature lower than the temperature in a normal radiating way by 10 degree Celsius or having a temperature higher than the temperature in a normal heating radiating way by 20-30 degree Celsius.

Compared with the air-conditioner in the prior art, since the heat pump system of the present application adopts the directly expanded strong cool-heat radiation plate 21 as the terminal of the main heat pump system 11, refrigerant in the main heat pump system 11 may exchange heat with air by means of the directly expanded strong cool-heat radiation plate 21 directly, instead of secondary heat exchange of the refrigerant loop and the water circulation loop, thereby reducing loss in intermediate heat exchange, improving the heat exchange efficiency and heat utilization, and omitting the circulating pump for water circulation so as to lower energy consumption and simplify the installation.

Figure 2:
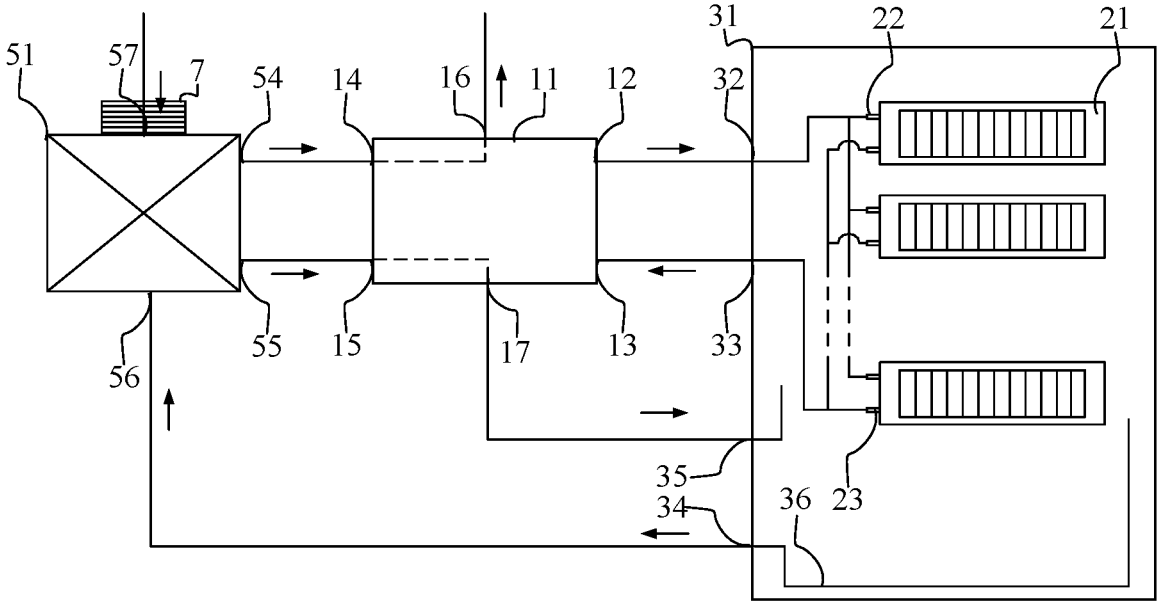
FIGS. 2 to 6 are schematic views of an air-conditioner according to embodiments of the present application.

For the purpose of saving energy further, as shown in FIG. 2, an air heat exchanger 51 is provided on the main heat pump system 11. Specifically, a return air inlet 56 of the air heat exchanger 51 communicates with a return air outlet 34 of a room 31; a second return air outlet 54 of the air heat exchanger 51 is connected to a heat source side air inlet 14 of the main heat pump system 11; a second replacement air outlet 55 of the air heat exchanger 51 communicates with a replacement air inlet 15 of the main heat pump system 11; and a first replacement air outlet 17 of the main heat pump system 11 communicates with a replacement air inlet 35 of the room 31.

A multistage air filter 7 is further provided at a replacement air inlet 57 of the air heat exchanger 51 in order to purify air.

When the main heat pump system 11 is running, the working medium in the main heat pump system 11 flows through a working medium feeding pipe into the directly expanded strong cool-heat radiation plate 21 arranged in the room 31. The working medium is evaporated as a result of absorbing heat from the room 31 so as to radiate cooling quantity (or condensed as a result of releasing heat into the room 31 so as to radiate heating quantity), and then returns to the main heat pump system 11 through a working medium discharging pipe. At the same time, outdoor fresh air flows into the air heat exchanger 51 via the multistage air filter 7, and makes primary heat exchange with the return air from the room 31 so as to obtain primary pre-cooled and filtered replacement air (or pre-heated and filtered replacement air). Then, the primary pre-cooled and filtered replacement air flows into the main heat pump system 11 to be secondarily pre-cooled and dehumidified (or preheated and humidified) so as to form the replacement air which will be supplied into the room 31. Return air undergoing primary heat recovery flows through a heat source side air inlet 14 into the main heat pump system 11, and return air undergoing secondary full heat recovery is discharged from an eduction air outlet 16 of the main heat pump system 11.

In order to improve the comfortable feeling in the room, a return air inlet 56 of the air heat exchanger 51 is also connected to a return air pipe 36 disposed in the room 31. The return air pipe 36 passes through a return air outlet 34 of the room 31. The provision of the return air pipe 36 may avoid the replacement air from short circuit, and improve indoor air quality.

Figure 9:
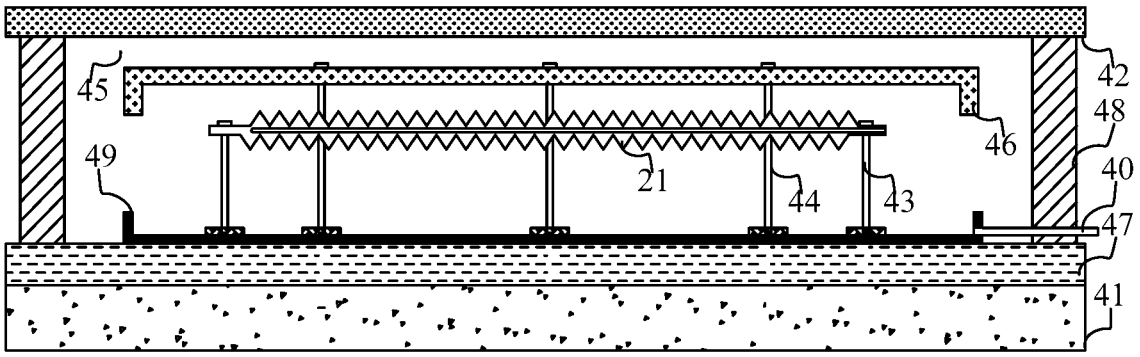
Figure 10:
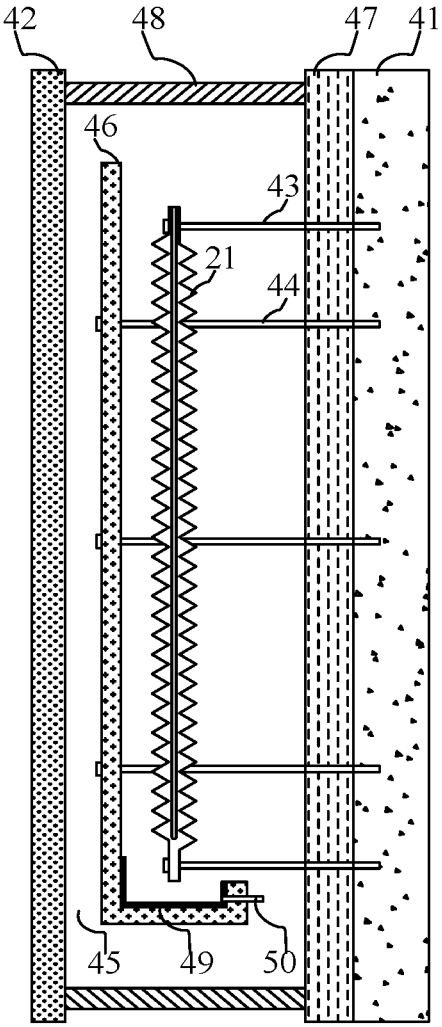
Figure 11:
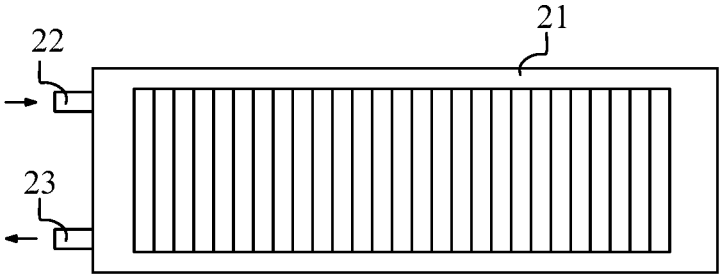
FIG. 11 is a schematic structural view of the directly expanded strong cool-heat radiation plate according to an embodiment of the present application.

Referring to FIGS. 7 to 11, FIGS. 7 to 10 are schematic views showing the installation of a directly expanded strong cool-heat radiation plate 21 according to embodiments of the present application; and FIG. 11 is a schematic structural view of a directly expanded strong cool-heat radiation plate 21 according to an embodiment of the present application.

Figure 7:
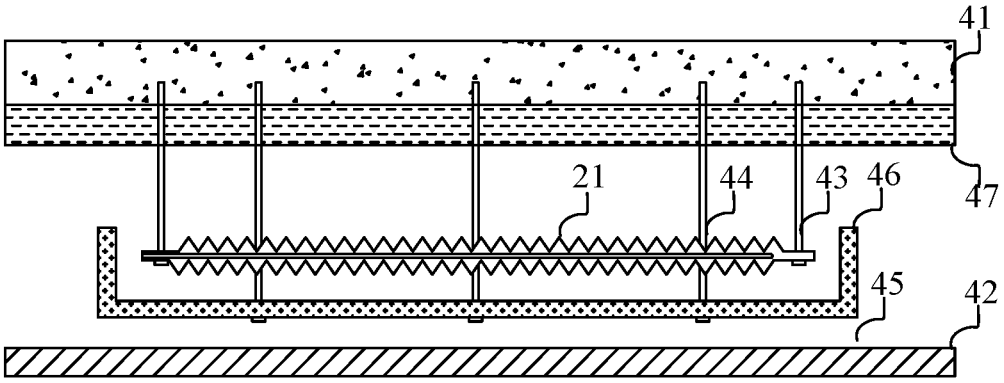
FIGS. 7 to 10 are schematic views showing the installation of a directly expanded strong cool-heat radiation plate according to a first embodiment of the present application.
Figure 8:
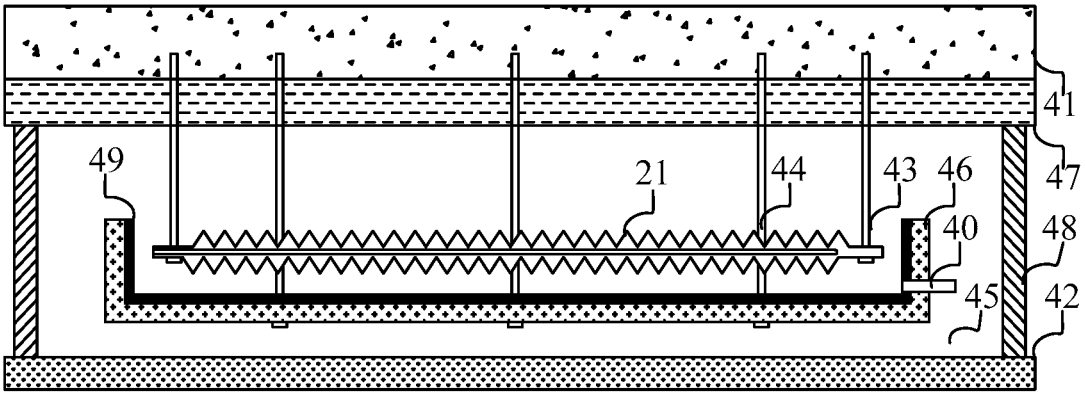

In order to reduce the loss of cool or heat quantity, a heat retaining layer 47 is provided on an inner surface 41 of a building. The directly expanded strong cool-heat radiation plate 21 is fixed to the inner surface 41 of the building by means of a first bracket 43. In order to reduce the dissipation of cool or heat quantity, a reflecting layer is provided on the outside surface of the heat retaining layer 47 which faces towards the interior of the room 31. The provision of the reflecting layer may transfer cool quantity (or heat quantity) radiated from the directly expanded strong cool-heat radiation plate 21 to the room 31 more efficiently. When the directly expanded strong cool-heat radiation plate 21 is provided on a different inner surface 41, the first bracket 43 may be varied. For example, when the inner surface 41 of the building is a top inner surface, as shown in FIGS. 7 and 8, the first bracket 43 may be of a flexible construction or a rigid construction; when the inner surface 41 of the building is a ground inner surface, as shown in FIG. 9, in order to ensure an appropriate space for installing a buffer plate 46 with respect to the directly expanded strong cool-heat radiation plate 21, and to ensure the thickness of a packed layer 45 and a firm supported heat radiating layer 42, the first bracket 43 is preferably of a rigid construction; and when the inner surface 41 of the building is a vertical inner surface, as shown in FIG. 10, similarly, in order to ensure an appropriate space for installing a buffer plate 46 with respect to the directly expanded strong cool-heat radiation plate 21, and to ensure the thickness of a packed layer 45 and a firm supported heat radiating layer 42, the first bracket 43 is preferably of a rigid construction.

To ensure the aesthetic appearance of the room 31 after the directly expanded strong cool-heat radiation plate 21 is mounted, the heat radiating layer 42 is provided on the side of the directly expanded strong cool-heat radiation plate 21 which is exposed to the outside, and the packed layer 45 with closed cavity structure is located between the heat radiating layer 42 and the directly expanded strong cool-heat radiation plate 21. The heat radiating layer 42 has different name depending on the different building surface 41. When the inner surface 41 of the building is a top inner surface, the heat radiating layer 42 is a ceiling or any face with ornamental effect. When the inner surface 41 of the building is a ground inner surface, the heat radiating layer 42 is a floor, and specifically, the floor could be lithoid floor, tile floor, metal floor, or wooden floor, etc. When the inner surface 41 of the building is a vertical inner surface, the heat radiating layer 42 is a false wall layer with ornamental effect.

The packed layer 45 has a cavity structure with a sealed space defined by the heat radiating layer 42, the directly expanded strong cool-heat radiation plate 21 and peripheral structures. Since the packed layer 45 is located between the heat radiating layer 42 and the directly expanded strong cool-heat radiation plate 21, it is possible to relieve the occurrence of moisture condensation because of local overcooling or the occurrence of overheating of the directly expanded strong cool-heat radiation plate 21 effectively in the cold or heat radiating process. The temperature of the heat radiating layer 42 is more uniform. The comfortable feeling in the room 31 is thus improved.

In order to further relieve the occurrence of moisture condensation because of local overcooling or the occurrence of overheating, the buffer plate 46 is located between the packed layer 45 and the directly expanded strong cool-heat radiation plate 21. The buffer plate 46 is fixed to the inner surface 41 of the building by means of a second bracket 44. The provision of the buffer plate 46 could weaken the transfer effect of cool or heat quantity from the directly expanded strong cool-heat radiation plate 21 to the room 31. When the main heat pump system performs refrigerating (or heating), the directly expanded strong cool-heat radiation plate 21 achieves secondary heat radiation under the combined effect of the buffer plate 46 and the packed layer 45, so that the temperature of the heat radiating layer 42 further tends to be uniform. The comfortable feeling in the room 31 is thus improved further.

In a further technical solution, in order to prevent damage to inner parts because of moisture condensation in a sealed space of assembly of the directly expanded strong cool-heat radiation plate 21, an anti-condensation trough 49 for receiving condensed water is provided below the directly expanded strong cool-heat radiation plate 21, and is provided therein with a condensate outlet 40. When the moisture condensation of the directly expanded strong cool-heat radiation plate 21 occurs, it will be collected in the anti-condensation trough 49, and drains via the condensate outlet 40 through a preset pipeline. As shown in FIG. 8, when the inner surface 41 of the building is a top inner surface, the anti-condensation trough 49 is provided on the buffer plate 46 entirely; as shown in FIG. 9, when the inner surface 41 of the building is a ground inner surface, the anti-condensation trough 49 is provided on the heat retaining layer 47 entirely; and as shown in FIG. 10, when the inner surface 41 of the building is a vertical inner surface, the anti-condensation trough 49 is provided at the lower portion of the buffer plate 46.

Since heat exchange efficiency of the heat pump system with the above structure is higher and the energy consumption is lower, when the directly expanded strong cool-heat radiation plate 21 of the heat pump system is mounted on the inner surface 41 of the building, construction and layout may be performed on a small area of the inner surface 41 of the building, rather than the whole inner surface 41 of the building. In order to achieve the sufficient strength, a supporting rod 48 adapted for supporting the heat radiating layer 42 is provided between the heat radiating layer 42 and the inner surface 41 of the building. Specifically, the supporting rods 48 may be arranged around the directly expanded strong cool-heat radiation plate 21, so as to separate the inner surface 41 of the building with the directly expanded strong cool-heat radiation plate 21 thereon from the inner surface 41 of the building without the directly expanded strong cool-heat radiation plate 21 thereon.

As shown in FIG. 11, the directly expanded strong cool-heat radiation plate 21 may include various effective heat transfer structures in which a refrigerant pipeline (copper pipe, aluminum pipe, etc.) and a fixed pipeline may be formed with the radiating surfaces. The radiating surfaces may be a metal plate or a surface cooler, etc. The directly expanded strong cool-heat radiation plate 21 may also be of a platy structure with various refrigerant cavity which may transfer heat effectively. The refrigerant in the main heat pump system 11 may be circulated in the plate, and a working medium inlet 22 and a working medium outlet 23 are provided in the directly expanded strong cool-heat radiation plate 21. The directly expanded strong cool-heat radiation plate 21 may be a single piece or multiple pieces. In case of multiple pieces, the multiple pieces of the directly expanded strong cool-heat radiation plate 21 are interconnected in series or in parallel.

Because the directly expanded strong cool-heat radiation plate 21 in the air-conditioner disclosed in the embodiments of the application exchanges heat with the room 31 directly, the intensity of the cooling and heating radiation is large, and the directly expanded strong cool-heat radiation plate 21 is mounted on a reduced area with ease. It is possible to ensure the cooling and heating quantity needed for comfortable feeling in the room 31, reduce the area of the room 31 for radiation, and have no effect on the use of space of the room 31.

An air-conditioner is further disclosed in an embodiment of the present application. As shown in FIGS. 1 to 6, the air-conditioner includes a chassis (not marked in the figures), and the main heat pump system 11 of the heat pump system in the above any solution is provided in the chassis. The working medium outlet 12 of the main heat pump system 11 communicates with the working medium inlet 22 of the directly expanded strong cool-heat radiation plate 21 via a working medium feeding pipe, and the working medium feeding pipe extends through an installation port 32 of the room 31. A working medium return inlet 13 of the main heat pump system 11 communicates with the working medium outlet 23 of the directly expanded strong cool-heat radiation plate 21 via a working medium return pipe, and the working medium return pipe extends through the installation port 33 of the room 31. The installation port 32 and the installation port 33 may be the same installation port.

Because the directly expanded strong cool-heat radiation plate 21 and the main heat pump system 11 are combined in the air-conditioner with the above heat pump system, the refrigerant in the main heat pump system 11 exchanges heat via the directly expanded strong cool-heat radiation plate 21 directly, instead of secondary heat exchange of the refrigerant loop and the water circulation loop, thereby reducing loss in intermediate heat exchange, improving the heat exchange efficiency and heat utilization, and omitting the circulating pump for water circulation so as to lower energy consumption and simplify the installation.

Figure 3:
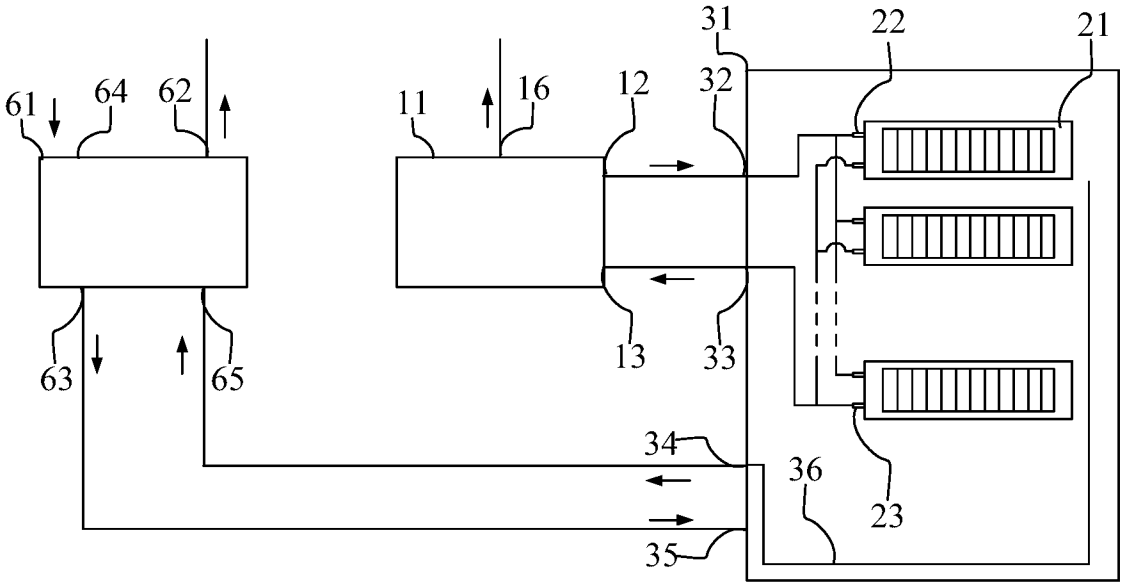

The main heat pump system may undertake both sensible heat load (radiation heat transfer) and latent heat load (replacement air pre-cooled dehumidification or preheated humidification) in the room 31. In order to further ensure the quality of the air and comfort in the room 31, as shown in FIG. 3, a replacement air heat pump system 61 is provided in the chassis of the air-conditioner. A replacement air outlet 63 of the replacement air heat pump system 61 is adapted to be connected to the replacement air inlet 35 of the room 31. If the room 31 is kept in a good temperature condition, or the sensible heat load is low, the main heat pump system 11 may be intermittently operated generally. In this case, when the main heat pump system 11 is stopped, the replacement air heat pump system 61 in the embodiment of the present application may filter pre-cooled dehumidified replacement air or may preheat (humidify) the replacement air such as to meet the desired humidity and quality.

Figure 4:
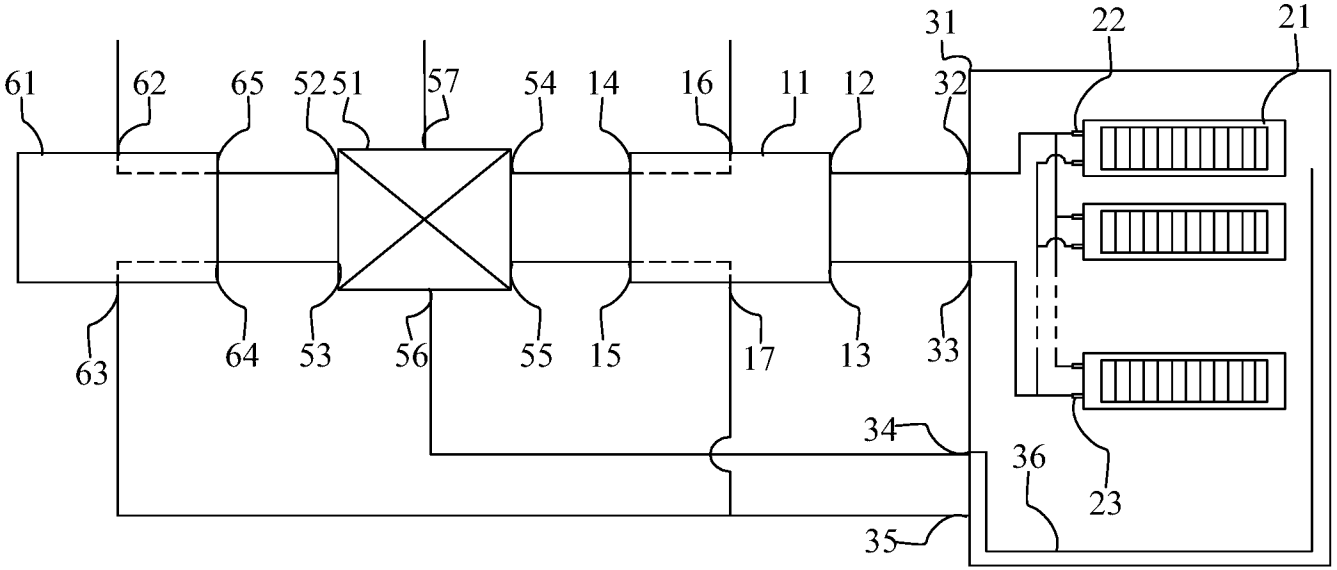
Figure 5:
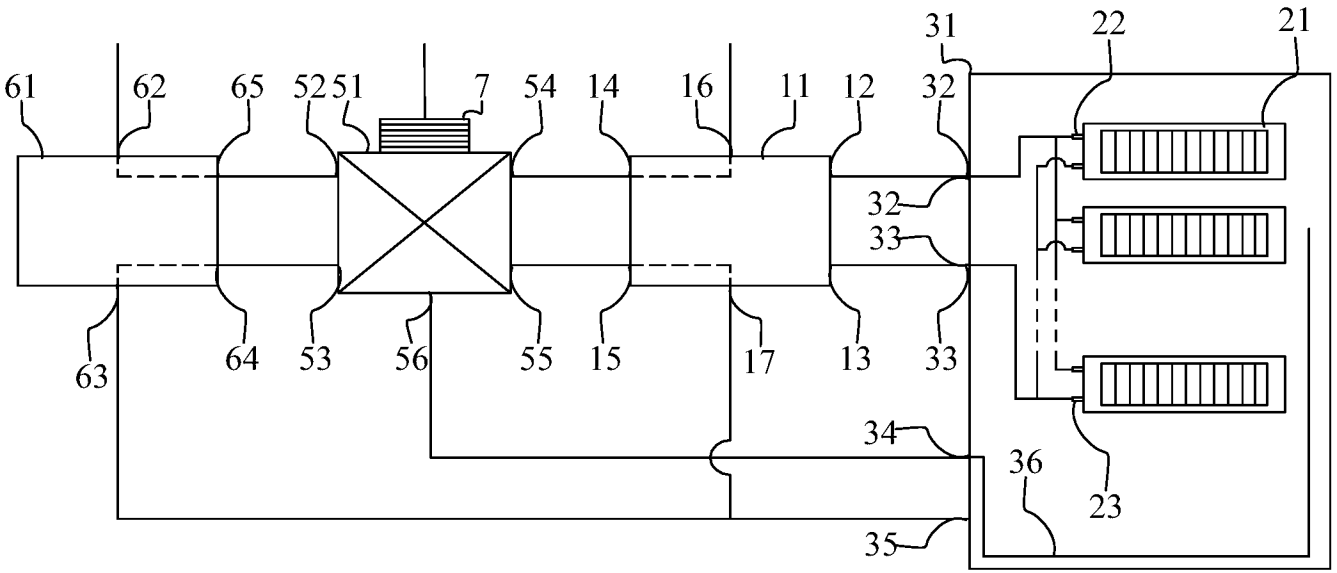
Figure 6:
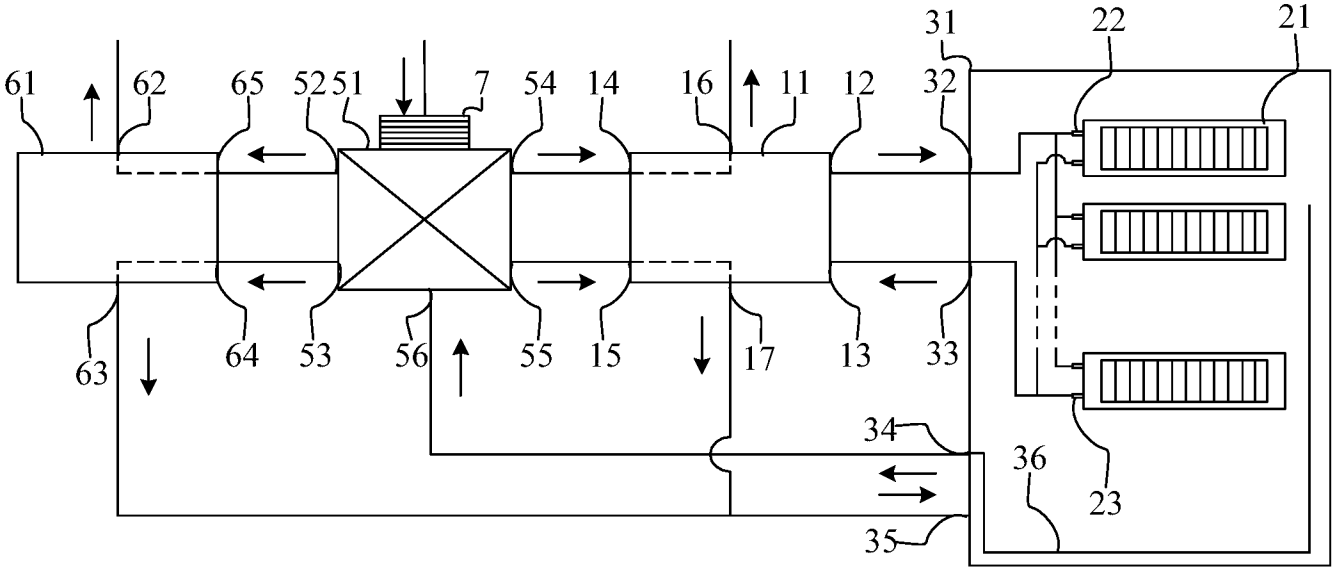

In order to reduce the energy consumption, as shown in FIG. 4, the air heat exchanger 51 is arranged between the main heat pump system 11 and the replacement air heat pump system 61. A first replacement air outlet 53 of the air heat exchanger 51 is connected to a replacement air inlet 64 of the replacement air heat pump system 61; a first return air outlet 52 of the air heat exchanger 51 is connected to a heat source side air inlet 65 of the replacement air heat pump system 61; the second replacement air outlet 55 of the air heat exchanger 51 is connected to the replacement air inlet 15 of the main heat pump system 11; the second return air outlet 54 of the air heat exchanger 51 is connected to the heat source side air inlet 14 of the main heat pump system 11; the return air inlet 56 of the air heat exchanger 51 is connected to the return air outlet 34 of the room 31; and a replacement air outlet 63 of the replacement air heat pump system 61 communicates with the replacement air inlet 35 of the room 31. As shown in FIGS. 5 to 6 in conjunction with FIG. 4, a multistage air filter 7 is provided at a replacement air inlet 57 of the air heat exchanger 51 in order to improve the quality of the replacement air flowing into the room 31.

As shown in FIG. 6, when the replacement air heat pump system 61 and the main heat pump system 11 are both running, working medium in the main heat pump system 11 flows through a working medium feeding pipe into the directly expanded strong cool-heat radiation plate 21 in the room 31. The working medium is evaporated as a result of absorbing heat from the room 31 so as to radiate cooling quantity (or condensed as a result of releasing heat into the room 31 so as to radiate heating quantity), and then returns to the main heat pump system 11 through a working medium discharging pipe. At the same time, outdoor fresh air flows into the air heat exchanger 51 via the multistage air filter 7, and makes primary heat exchange with the return air from the room 31 so as to obtain primary pre-cooled (or pre-heated) and filtered replacement air, a part of which flows into the replacement air heat pump system 61, and the other part of which flows into the main heat pump system 11 to be secondarily pre-cooled and dehumidified (or preheated and humidified) so as to form the replacement air which will be supplied into the room 31. A part of return air undergoing primary heat recovery flows into a second heat source side air inlet 65 of the replacement air heat pump system 61, and the other part of the return air flows through a heat source side air inlet 14 into the main heat pump system 11, and is discharged from the eduction air outlet 16 of the main heat pump system 11 and an eduction air outlet 62 of the replacement air heat pump system 61 after secondary full heat recovery is performed.

For the above air-conditioner, only the directly expanded strong cool-heat radiation plate 21, the replacement air inlet 35, the return air outlet 34, and the return air pipe 36 need to be arranged in the room 31. The temperature in the room 31 is uniform, without the blown feeling and the noise of the apparatus. In addition, with the replacement air heat pump system 61, the conditioned air in the room 31 is fresh, has stable humidity and clean environment, thereby greatly improving the comfort in the room. Also, such an facility is easy to be installed, and may achieve a strong cooling radiation with a large temperature difference without moisture condensation, nor a strong heating radiation with a large temperature difference without dry and hot feeling, and may have a power of the facility reducing more than fifty percent than the conventional air-conditioner. The use of the air heat exchanger 51 enables an efficient full cool-heat recovery in the replacement air system, a simple structure, small volume, and a low cost.

Figure 12:
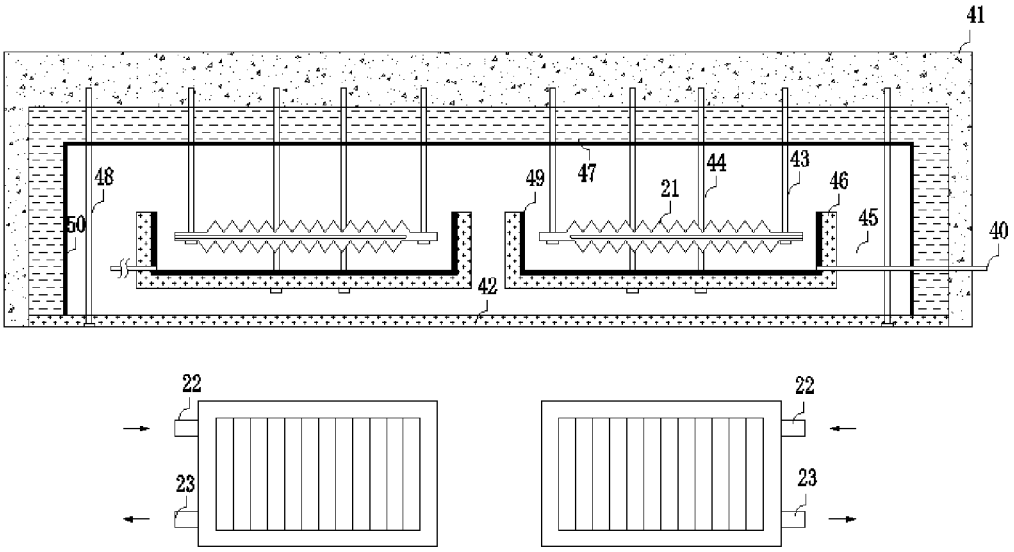
FIGS. 12 to 14 are schematic views showing the installation of the directly expanded strong cool-heat radiation plate according to a second embodiment of the present application.
Figure 13:
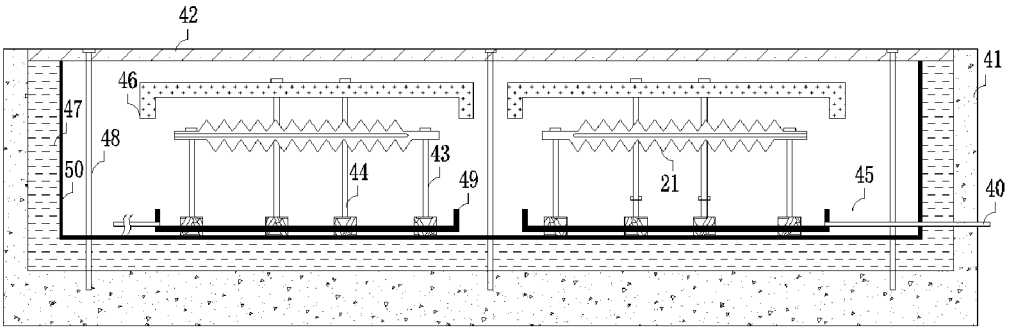
Figure 14:
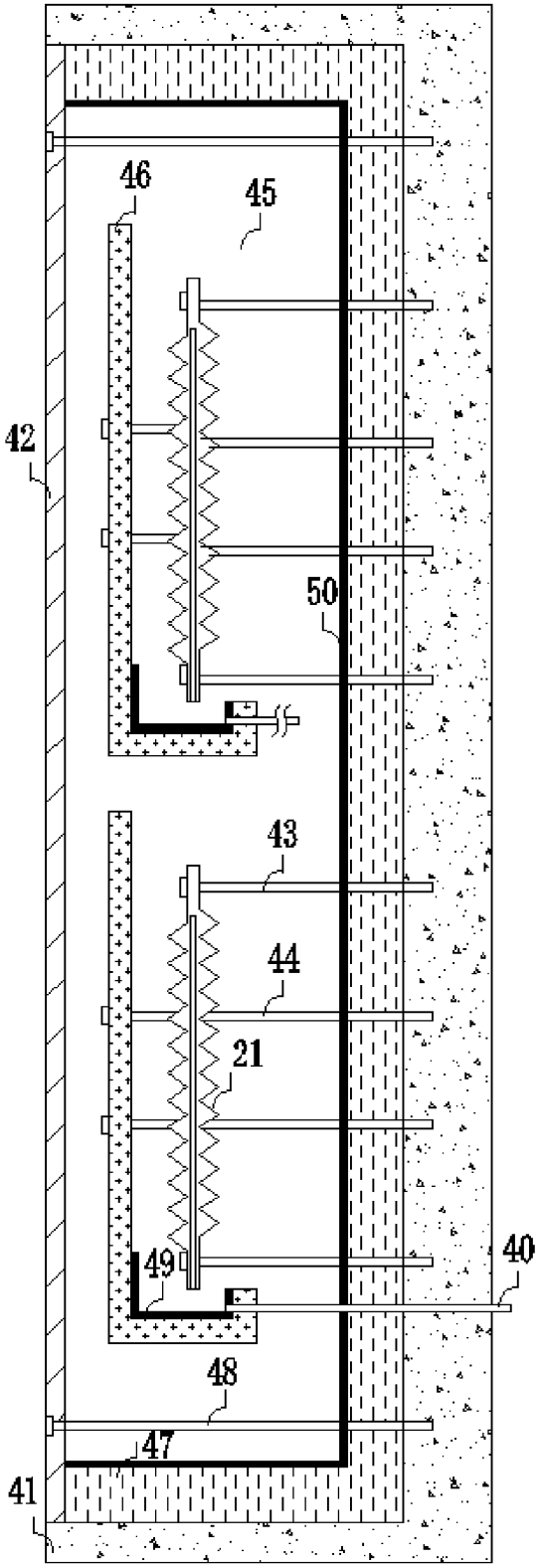

Referring to FIGS. 12 to 14, another embodiment is described in detail hereinafter.

After being constructed, a building may have multiple rooms. Each of the rooms may have multiple inner surfaces 1. It may be appreciated that one room may be in a cubic shape, a cylindrical shape, and etc. The embodiment is described by taking a cubic shape as an example.

Referring to FIG. 12, the inner surface 41 of the building is the top inner surface, and the radiating layer 42 is arranged at a position having a distance from the top inner surface. The retaining layer 47 is directly or indirectly coated on the top inner surface, which may retain heat or cold from being transferred out of the room. The reflecting layer 50 is directly or indirectly coated on the retaining layer 47, which may reflect heat or cold into the room. The directly expanded strong cool-heat radiation plate 21 is mounted under the top inner surface through the first bracket 43. The buffer plate 46 is mounted below the directly expanded strong cool-heat radiation plate 21 through the second bracket 44, which may weaken the transferring cool or heat quantity from the directly expanded strong cool-heat radiation plate 21 to the room 31. The anti-condensation trough 49 may fit on the buffer 46, and the shape of the anti-condensation trough 49 may be same with the shape of the buffer plate 46. The condensation discharging pipe 40 is configured to discharge the condensation collected by the directly expanded strong cool-heat radiation plate. A wall surface is formed by a combination of the top inner surface and partial vertical inner surface above the heat radiating layer as well as the heating retaining layer 47 and the reflecting layer 50. The sealed cavity is enclosed by the wall surface and the heat radiating layer 42. The sealed cavity is filled with air.

FIG. 12 also shows a plan view of two directly expanded strong cool-heat radiation plate 21. The working medium inlet 22 of the directly expanded strong cool-heat radiation plate 21 and the working medium outlet 23 of the directly expanded strong cool-heat radiation plate 21 are shown.

In FIG. 13, the directly expanded strong cool-heat radiation plate 21 is mounted above the ground inner surface. The buffer plate 46 is arranged above the directly expanded strong cool-heat radiation plate 21, and the anti-condensation trough 49 is mounted below the directly expanded strong cool-heat radiation plate 21. The wall surface is formed by a combination of the ground inner surface and partial vertical inner surface below the heat radiating layer 42 as well as the heat retaining layer 47 and the reflecting layer 50, and the sealed cavity is enclosed by the wall surface and the heat radiating layer 47. The sealed cavity is filled with air.

In FIG. 14, the directly expanded strong cool-heat radiation plate 21 is mounted on the vertical inner surface. The buffer plate 46 is arranged at a side, close to the heat radiating layer 42, the directly expanded strong cool-heat radiation plate 21, and the anti-condensation trough 49 is mounted below the directly expanded strong cool-heat radiation plate 21. The wall surface is formed by a combination of partial top inner surface, partial ground inner surface and partial vertical inner surface below the heat radiating layer 42 as well as the heat retaining layer 47 and the reflecting layer 50, and the sealed cavity is enclosed by the wall surface and the heat radiating layer 47. The sealed cavity is filled with air.

In the present application, the air in the sealed cavity surrounds the buffer plate 46, the anti-condensation trough 49, thus, frozen water may be formed and condensation will not be formed. Even if the temperature of the working medium in the directly expanded strong cool-heat radiation plate is decreased to 3-5 degree Celsius, condensation will not be formed. Since the packed layer accommodates the buffer plate and the top inner surface and thus multi-stage adjustment is implemented, the temperature of the heat radiating layer will be higher than the temperature of the dew-point temperature, which may effectively prevent the condensation. Even if a small amount of condensation is formed in an initial operation due to the moisture in the packed layer, the condensation may be discharged from the anti-condensation trough. Similarly, in the heat radiating process, the temperature of the working medium may reach 60-70 degree Celsius, and then after multi-stage adjustment through the buffer plate and the top inner surface, the temperature of the heat radiating layer may finally reach 60-70 degree Celsius, thus the temperature of the room is uniform, and no space in the room is overheated, making people comfortable.

The above description of the disclosed embodiments enables the person skilled in the art to practice and use the application. Various modifications to these embodiments may be obvious to the person skilled in the art. The general principle defined therein may be implemented in other embodiments without departing from the spirit and scope of the application. Thus, the application is not limited to these embodiments illustrated herein, but conforms to a broadest scope consistent with the principle and novel features disclosed herein.

What is claimed is:

1. A heat pump system, comprising:

a main heat pump system;

a heat retaining layer coated on an partial inner surface of a building;

a reflecting layer coated on the heat retaining layer;

a directly expanded strong cool-heat radiation plate having a distance from the reflecting layer, wherein an interior of the directly expanded strong cool-heat radiation plate is communicated with the main heat pump system such that refrigerant is circulated in the directly expanded strong cool-heat radiation plate and the main heat pump system;

a heat radiating layer located at a side, towards an interior of a room, of the directly expanded strong cool-heat radiation plate and having a distance from the directly expanded strong cool-heat radiation plate;

a supporting rod for supporting the heat radiating layer;

a first bracket for supporting the directly expanded strong cool-heat radiation plate;

a buffer plate disposed between the heat radiating layer and the directly expanded strong cool-heat radiation plate, wherein the buffer plate is configured to weaken the transferring cool or heat quantity from the directly expanded strong cool-heat radiation plate to the room;

a second bracket for supporting the buffer plate;

an anti-condensation trough disposed below the directly expanded strong cool-heat radiation plate, wherein the anti-condensation trough includes a condensation discharging pipe extending out of the room;

wherein a sealed cavity is enclosed by the heat radiating layer and a wall surface, and the wall surface is formed by a combination of the partial inner surface of the building, the heat retaining layer and the reflecting layer, and, the sealed cavity is filled with air.

2. The heat pump system according to claim 1, wherein the directly expanded strong cool-heat radiation plate is a single piece.

3. The heat pump system according to claim 1, wherein the directly expanded strong cool-heat radiation plate comprises a plurality of pieces, and the plurality of pieces of the directly expanded strong cool-heat radiation plate are interconnected in series or in parallel.

4. The heat pump system according to claim 1, wherein, when the directly expanded strong cool-heat radiation plate is disposed on a top inner surface of the building, the heat radiating layer is a ceiling; when the directly expanded strong cool-heat radiation plate is disposed on a ground inner surface of the building, the heat radiating layer is a floor; when the directly expanded strong cool-heat radiation plate is disposed on a vertical inner surface of the building, the heat radiating layer is a false wall layer.

5. The heat pump system according to claim 4, wherein, when the directly expanded strong cool-heat radiation plate is disposed on the top inner surface of the building, the wall surface is formed by a combination of the top inner surface and partial vertical inner surface above the heat radiating layer as well as the heat retaining layer and the reflecting layer; when the directly expanded strong cool-heat radiation plate is disposed on the ground inner surface of the building, the wall surface is formed by a combination of the ground inner surface and partial vertical inner surface below the heat radiating layer as well as the heat retaining layer and the reflecting layer; when the directly expanded strong cool-heat radiation plate is disposed on the vertical inner surface of the building, the wall surface is formed by a combination of partial vertical inner surface, partial top inner surface, and partial ground inner surface as well as the heat retaining layer and the reflecting layer.

6. The heat pump system according to claim 1, wherein the directly expanded strong cool-heat radiation plate is provided with a plurality of louvers for enhancing nature convection.

7. The heat pump system according to claim 1, wherein the directly expanded strong cool-heat radiation plate is a plate having a plurality of gaps and formed by a plurality of copper pipes and a plurality of fins.

8. The heat pump system according to claim 1, wherein the anti-condensation trough is arranged in an inclined way such that condensation is discharged from a discharging port.

9. An air-conditioner, comprising:

a chassis, and the heat pump system according to claim 1;

wherein the main heat pump system of the heat pump system is provided in the chassis.

10. The air-conditioner according to claim 9, further comprising:

a replacement air heat pump system provided in the chassis, wherein a replacement air outlet of the replacement air heat pump system is adapted to be connected to a replacement air inlet of a room.

11. The air-conditioner according to claim 10, wherein an air heat exchanger is provided between the main heat pump system and the replacement air heat pump system, and wherein a first replacement air outlet of the air heat exchanger is connected to a replacement air inlet of the replacement air heat pump system, a first return air outlet of the air heat exchanger is connected to a heat source side air inlet of the replacement air heat pump system, a second replacement air outlet of the air heat exchanger is connected to a replacement air inlet of the main heat pump system, a second return air outlet of the air heat exchanger is connected to a heat source side air inlet of the main heat pump system, a return air inlet of the air heat exchanger is connected to a return air outlet of the room.

12. The air-conditioner according to claim 11, wherein a multistage air filter is provided at a replacement air inlet of the air heat exchanger.

13. The air-conditioner according to claim 12, wherein the return air inlet of the air heat exchanger is also connected to a return air pipe arranged in the room.

* * * * *